US006945255B2

(12) United States Patent
Kampel et al.

(10) Patent No.: US 6,945,255 B2
(45) Date of Patent: Sep. 20, 2005

(54) HAIR ROLLER WITH A CERAMIC COATING

(75) Inventors: Michelle Kampel, Fairfield, CT (US); Martin A. Cohen, Ridgefield, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/758,602

(22) Filed: Jan. 15, 2004

(65) Prior Publication Data

US 2004/0163662 A1 Aug. 26, 2004

Related U.S. Application Data

(60) Provisional application No. 60/440,143, filed on Jan. 16, 2003.

(51) Int. Cl.[7] ..... A45D 2/12
(52) U.S. Cl. ..... 132/226; 132/262
(58) Field of Search ..... 132/262, 163, 132/222, 260, 245, 226; 219/222

(56) References Cited

U.S. PATENT DOCUMENTS

| | | | | |
|---|---|---|---|---|
| 3,474,796 | A | * 10/1969 | Fineman | 132/226 |
| 3,485,248 | A | 12/1969 | Murray et al. | |
| 3,486,000 | A | 12/1969 | D'Elia et al. | |
| 3,515,851 | A | 6/1970 | D'Elia et al. | |
| 3,516,421 | A | 6/1970 | Rosmarin | |
| 3,559,564 | A | 2/1971 | Henry et al. | |
| 3,560,703 | A | 2/1971 | Chedister | 219/222 |
| 3,560,704 | A | 2/1971 | Albert | 219/222 |
| 3,584,632 | A | 6/1971 | Weidner | 132/9 |
| 3,603,765 | A | 9/1971 | Underwood | 219/222 |
| 3,632,971 | A | 1/1972 | Flanagan | 219/222 |
| 3,784,784 | A | 1/1974 | Geominy et al. | 219/222 |
| 3,805,811 | A | 4/1974 | Dorn | 132/37 R |
| 3,835,292 | A | 9/1974 | Walter et al. | 219/222 |
| 3,934,114 | A | 1/1976 | Godel et al. | 219/222 |
| 3,973,100 | A | 8/1976 | Flanagan | 219/222 |
| 4,004,596 | A | 1/1977 | Hyland | 132/37 |
| 4,032,747 | A | 6/1977 | Kunz | 219/222 |
| 4,040,415 | A | 8/1977 | Kulisch | 601/168 |
| 4,045,763 | A | 8/1977 | Miyamoto et al. | 338/23 |
| 4,097,718 | A | 6/1978 | Weise | 219/222 |
| 4,109,667 | A | 8/1978 | Quirk | 132/233 |
| 4,126,143 | A | 11/1978 | Schroeder | 132/118 |
| 4,151,850 | A | 5/1979 | Nathe et al. | 132/225 |
| 4,163,143 | A | 7/1979 | Federico et al. | 219/225 |
| 4,203,026 | A | 5/1980 | Walter et al. | 219/222 |
| 4,242,567 | A | 12/1980 | Carter | 219/225 |
| 4,267,431 | A | 5/1981 | Rick et al. | 219/225 |
| RE30,866 | E | 2/1982 | Barradas | 132/227 |
| 4,327,752 | A | 5/1982 | Hickel | 132/263 |
| 4,342,323 | A | 8/1982 | Rick et al. | 132/232 |
| 4,368,376 | A | 1/1983 | Andis | 219/222 |
| 4,374,528 | A | 2/1983 | Tittert | 132/263 |
| 4,382,448 | A | 5/1983 | Tittert | 132/232 |
| 4,477,716 | A | 10/1984 | Thaler et al. | 219/225 |
| 4,479,047 | A | 10/1984 | Khaja et al. | 219/225 |
| 4,567,904 | A | 2/1986 | Pitcher et al. | 132/266 |
| 4,581,519 | A | 4/1986 | Thaler et al. | 219/225 |
| 4,697,066 | A | 9/1987 | Glucksman | 219/225 |
| 4,699,159 | A | * 10/1987 | Thaler | 132/226 |
| 4,740,669 | A | * 4/1988 | Takimae | 219/225 |

(Continued)

*Primary Examiner*—John J. Wilson
*Assistant Examiner*—Robyn Doan
(74) *Attorney, Agent, or Firm*—Ohlandt, Greeley, Ruggiero & Perle, L.L.P.

(57) ABSTRACT

A hair care appliance has a body with an outer layer, and a first end and a second end connected to the body. The first end and the second end are for grasping the hair care appliance. The hair care appliance also has an adhesive layer on the outer layer of the body, and a flocking with a material in/on the adhesive layer. The material retains heat to assist in styling of the hair.

20 Claims, 8 Drawing Sheets

U.S. PATENT DOCUMENTS

| | | | | |
|---|---|---|---|---|
| 4,784,784 | A | 11/1988 | Dohner | 252/79 |
| 4,829,156 | A | 5/1989 | Thompson | 219/225 |
| 4,841,127 | A | 6/1989 | Prager et al. | 219/225 |
| 4,849,593 | A | 7/1989 | Hughes et al. | 219/759 |
| 4,866,248 | A | 9/1989 | Altamore | 219/225 |
| 4,870,250 | A | 9/1989 | Rizzuto et al. | 219/225 |
| 4,936,027 | A | 6/1990 | Tsuji | 34/90 |
| 5,046,516 | A | 9/1991 | Barradas | 132/232 |
| 5,105,065 | A | 4/1992 | Shibata | 219/227 |
| 5,120,933 | A | 6/1992 | Altamore et al. | 219/225 |
| 5,157,005 | A | 10/1992 | Suppiah | 502/62 |
| 5,191,907 | A | 3/1993 | Hirzel | 132/107 |
| 5,263,501 | A | 11/1993 | Maznik | 132/211 |
| 5,320,089 | A | 6/1994 | Schaefer et al. | 126/409 |
| 5,357,988 | A | 10/1994 | Nakamura | 132/232 |
| 5,573,016 | A | * 11/1996 | Graves | 132/254 |
| 5,673,710 | A | 10/1997 | Schaefer et al. | 132/118 |
| 5,704,377 | A | 1/1998 | McMullen | 132/217 |
| 5,740,820 | A | 4/1998 | Stern | 132/249 |
| 5,773,802 | A | 6/1998 | Graves | 219/759 |
| 5,783,800 | A | 7/1998 | Thompson et al. | 219/225 |
| 5,793,018 | A | 8/1998 | Jett | 219/225 |
| 5,799,671 | A | 9/1998 | Takimae | 132/225 |
| 5,810,026 | A | 9/1998 | Sham | 132/232 |
| 5,823,204 | A | 10/1998 | Todd | 132/208 |
| 5,832,939 | A | 11/1998 | Nathe | 132/225 |
| 5,857,470 | A | 1/1999 | Schmidt et al. | 132/211 |
| 5,868,146 | A | 2/1999 | Henninger et al. | 132/232 |
| 6,029,677 | A | 2/2000 | Nanba et al. | 132/225 |
| 6,061,912 | A | 5/2000 | Gazaway | 30/140 |
| 6,119,702 | A | 9/2000 | Habibi | 132/224 |
| 6,199,558 | B1 | 3/2001 | Schmidt et al. | 132/211 |
| 6,310,322 | B1 | 10/2001 | Yang et al. | 219/386 |
| 6,354,305 | B1 | 3/2002 | Janouch et al. | 132/232 |
| 6,360,752 | B1 | 3/2002 | Chang | 132/277 |
| 6,397,856 | B1 | 6/2002 | Lo | 132/229 |

* cited by examiner

HAIR ROLLER WITH A CERAMIC COATING

CROSS-REFERENCE TO RELATED APPLICATIONS

This application claims priority to U.S. Provisional Patent Application Ser. No. 60/440,143 filed on Jan. 16, 2003.

BACKGROUND OF THE INVENTION

1. Field of the Invention

The present invention relates to hair rollers. More particularly, the present invention relates to hair rollers made from a ceramic material for improved hair curling action.

2. Description of the Related Art

Hair rollers are known in the art. Hair rollers are usually heated for increased curling action. Hair rollers are usually made in a first part and a second part. The first part is usually a core of the hair roller. The second part is a sheath of the hair roller. The sheath is disposed around the core to surround the core. The core is usually made from a thermally conductive material such as an aluminum material, copper, steel or any other suitable metal. The sheath is usually made from a thermally non-conductive material. The sheath preferably is made to easily connect to the core. The sheath may be a wax or a polypropylene.

Prior art hair rollers heat up in a quick manner because of the thermally conductive properties of the aluminum or metal core material. The user can easily manipulate the heated core by gripping the heated hair rollers by grasping the sheath.

The prior art hair rollers may also have a flocking. A flocking is a treatment or coating that is applied to an outer surface of the hair roller. The flocking is typically one or more particles or pieces that are connected to the hair roller for improving a texture of the hair roller. The one or more particles or pieces are typically a soft material such a cloth material. The soft material is on the core and/or the sheath of the prior art hair rollers. The flocking avoids any scratching or corrosion on the core or the sheath, in addition to giving the core or the sheath of the hair roller the improved texture. The flocking provides that when a user rubs a finger or an amount of hair over the outer surface of the hair roller, the hair roller has a beneficial feel that is smooth, soft and substantially similar to felt.

Prior art hair rollers are usually placed in a hair roller compartment. The hair roller compartment has a heater. Prior to a commencement of styling the user's hair, the hair rollers are in the heater in the hair roller compartment. The heater heats the core of each of the number of hair rollers placed in the hair roller compartment in a very fast and rapid manner. The heater heats the hair rollers until such a time as the hair rollers are needed for curling the hair. Contemporaneously, the sheath does not heat in the same fast and rapid manner. Instead, the sheath is maintained cool relative to the heated core. The user can grasp the hair roller by the sheath and wind the user's hair around the hair roller for curling the hair.

However, the prior art hair rollers are limited in their operation and benefits imparted to the hair during styling. Unfortunately, the prior art hair roller having its core made from metal will also cool in a very quick manner over a short time interval. This results in an uneven heating that is detrimental for hair curling. At the outset, the hair roller is heated to a maximum level only to cool to a minimum level over a relatively short time interval while the hair is wound around the particular hair roller. Also, the sheath does not adequately retain heat for any extended period of time. This cooling will result in the hair roller forming curls that are unevenly heated and looser than is desired by the stylist. Moreover, these curls will not last over any extended period of time due to the heat applied to the hair.

The aluminum or metal core will further create more difficulty for the stylist. The stylist will be forced to undo the curl upon such cooling. Then the stylist will reheat the hair roller or replace it with a fresh hair roller and then reapply the new heated hair roller for the desired curling action. This may further cause the stylist increased amounts of professional time to create the curls and extend the amount of time to style each individual's hair. Accordingly, there is a need for a hair roller that eliminates one or more of the aforementioned drawbacks and deficiencies of the prior art.

SUMMARY OF THE INVENTION

It is an object of the present invention to provide a hair roller that retains heat and radiates heat evenly at a preferred wavelength for an extended period of time.

It is another object of the present invention to provide a hair roller that is easy to grasp and manipulate for styling and that has an outer surface to grip the hair wound around the hair roller.

It is still another object of the present invention to provide a hair roller that has an improved texture.

It is yet another object of the present invention to provide a hair roller that radiates heat for an extended period of time.

It is still yet another object of the present invention to provide a hair roller that has a flocking with a number of ceramic particles being disposed in the flocking.

It is a further object of the present invention to provide a hair roller that has a body having an outer surface with the outer surface having a ceramic carrying paint disposed thereon.

It is still a further object of the present invention to provide a hair roller that has a body with an outer surface that has ground or powdered ceramic in a paint with titanium dioxide therein.

These and other objects and advantages of the present invention are achieved by a hair roller for hair curling of the present invention. The hair roller has a body with a diameter, a height and an outer surface for winding the hair desired to be curled therearound. The hair roller also has a flocking. The flocking is disposed on the outer surface. An adhesive is also disposed around the outer surface of the body. The adhesive preferably connects the flocking to the hair roller. The hair roller further has a ceramic. The ceramic is in the flocking and is connected to the outer surface by the adhesive. The ceramic retains heat to assist in the curling of the hair.

DETAILED DESCRIPTION OF THE INVENTION

Figure 1:
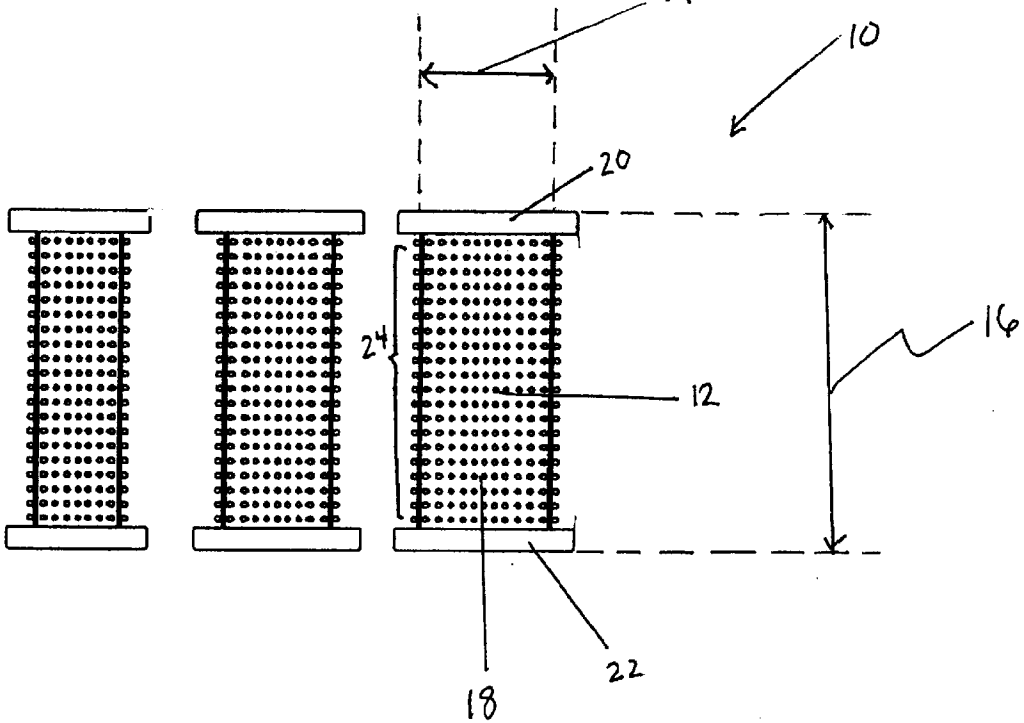
FIG. 1 is a side view of a preferred embodiment of a first hair roller, a second hair roller, and a third hair roller according to the present invention each having different sizes.

Referring to FIG. 1, there is provided a hair roller of the present invention generally represented by reference numeral 10. The hair roller 10 preferably has a body 12 with a substantially cylindrical shape. The body 12 has a diameter 14, a height 16 and an outer surface 18. The outer surface 18 preferably defines a path for which to wind hair therearound for curling.

As is shown in FIG. 1, the body 12 may be fabricated in any number of different sizes to create hair curls of different diameters and shapes. One skilled in the art should appreciate that the hair roller 10 may have any diameter 14 known in the art suitable for styling hair. The body 12 is shown as made from a resilient material such as a thermoplastic, or any other suitable resilient material that is known in the art, or a metal material such as aluminum, steel, copper, any thermally conductive material.

Preferably, one or more such hair rollers 10 shown in FIG. 1 are all initially disposed in a suitable hair roller compartment or hair roller appliance casing (not shown). The hair roller compartment has a heater connected to a power supply and a lid. The hair roller 10 is placed in the hair roller compartment and is heated by the heater in the hair roller compartment. Preferably, the hair roller 10 is heated any suitable temperature typically used in ordinary hair rollers. Thereafter, the stylist opens the lid and removes the heated hair roller 10 from the hair roller compartment. Alternatively, a conventional hair dryer may also heat the hair roller 10.

For curling, the stylist will wind a user's hair around the outer surface 18 of the hair roller 10 and secure the hair in a wound position around the outer surface by using a suitable fastener. Preferably, the hair is secured on the hair roller 10 simply by rolling the hair into the hair roller. Optionally, a spring clip may be also clamped around the hair bound hair roller 10. One problem with prior art hair rollers made from a thermally conductive metal is that the hair roller heats in a rapid and swift manner but also cools relatively quickly. This allows the prior art hair roller to radiate heat in a very uneven manner at a number of different wavelengths during a period of time that the hair is wound around the hair roller. The hair roller 10 of the present invention preferably remedies this longstanding problem and generally improves styling of the hair by evenly heating the hair for an extended period of time at a constant wavelength.

Figure 2:
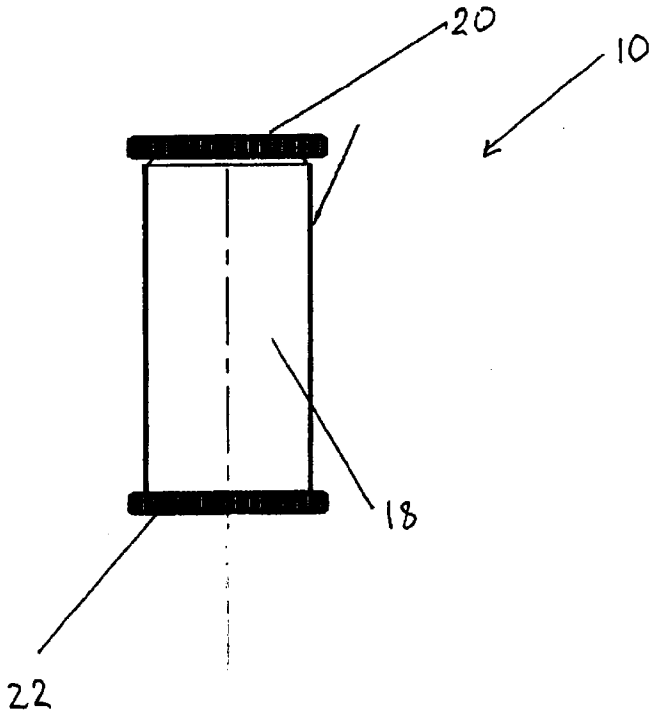
FIG. 2 is a side view of the hair roller of FIG. 1 with a first end cap and a second end cap.

Referring to FIG. 2, the hair roller 10 has a first end cap 20 and a second end cap 22. The first end cap 20 and the second end cap 22 preferably are each made from a suitable non-thermally conductive material. The first end cap 20 and the second end cap 22 preferably allow a user to easily lift the hair roller 10 from the hair roller compartment without any touching of the heated outer surface 18 or any other heated portions of the hair roller 10.

Figure 3:
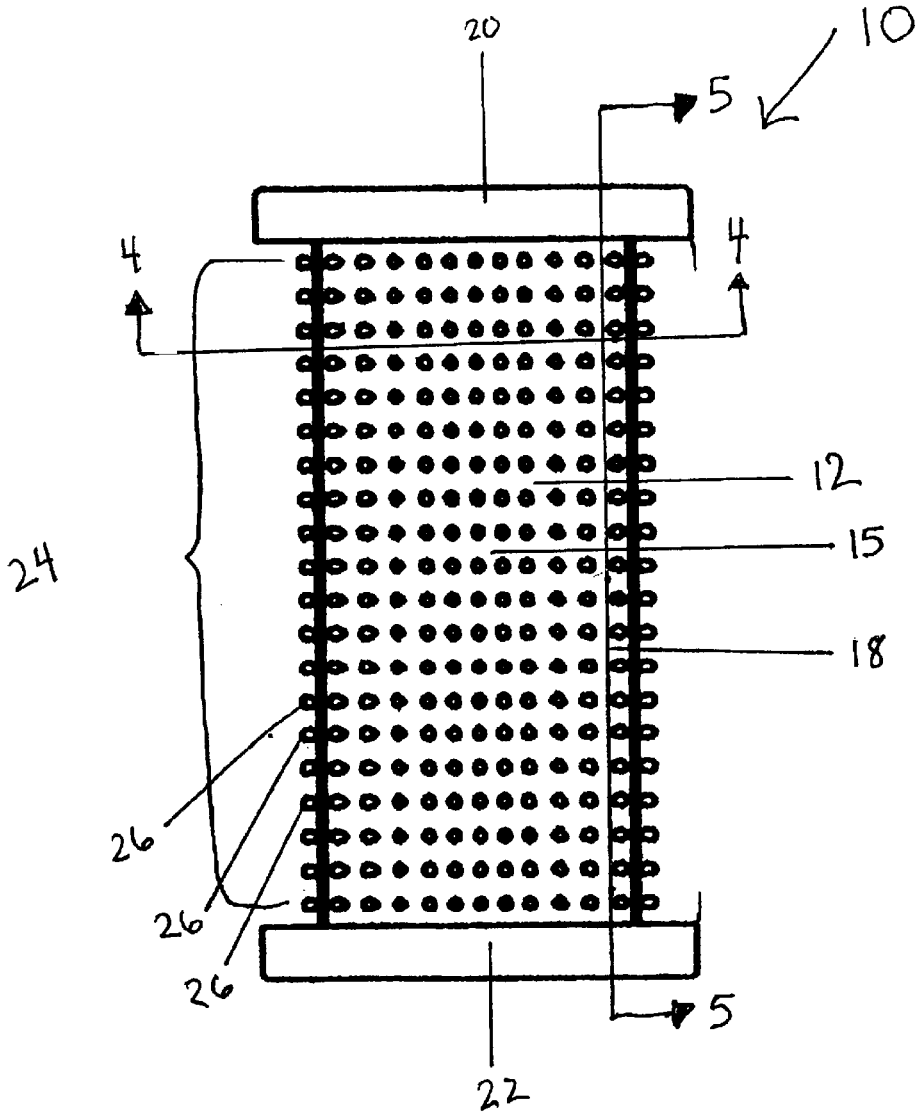
FIG. 3 is another side view of the hair roller of FIG. 1 with a flocking.

Referring to FIG. 3, the outer surface 18 of the hair roller 10 has a flocking 24 connected thereto. The flocking 24 is preferably disposed substantially entirely around the outer surface 18. The flocking 24 is preferably a coating or a layer of a substance around a circumference of the outer surface 18. The flocking 24 of the present invention improves one or more styling characteristics of the hair roller 10. In one embodiment, the flocking 24 is connected to the outer surface 18 by an adhesive layer 32 that is between the flocking 24 and the outer surface.

Preferably, the adhesive layer 32 is disposed entirely around the outer surface 18 of the hair roller 10 and has a thickness. Also, the flocking 24 is disposed over the adhesive layer 32 and has a ceramic 15 disposed therein.

The flocking 24 has a soft material therein. Preferably, the flocking 24 has one or more nylon fibers 26. The one or more nylon fibers 26 are disposed in spaced relation from each other and in a pattern on the outer surface 18. Preferably, the one or more nylon fibers 26 are adhered by adhesive to the outer surface 18, however one skilled in the art should appreciate that any method of connecting the nylon fibers 26 is in the scope of the present invention such as connection by molding or by mechanical fasteners.

The one or more nylon fibers 26 in the flocking 24 are each preferably connected to the outer surface 18 so that each nylon fiber is oriented substantially perpendicular to the outer surface as shown in FIG. 3. In this manner, each nylon fiber 26 in the flocking 24 contacts the user's skin and/or hair and can yield to any pressure applied to the nylon fiber 26. In this manner, the flocking 24 provides for improved soft texture when touched by the stylist or applied to the user's hair. However, one skilled in the art should appreciate that the flocking 24 may be any fabric, soft material or particles known in the art to improve the texture of the outer surface 18.

In one aspect, the flocking 24 preferably protects the body 12 of the hair roller 10 by preventing any scratching or corrosion thereof by scissors, comb or any other objects. The flocking 24 has one or more materials that allows the hair roller 10 to radiate heat to the hair for an extended period of time at a constant wavelength. Still further, the one or more materials disposed in the flocking 24 increase a coefficient of friction of the flocking. This permits the hair wound around the hair roller 10 to be retained more easily on the outer surface 18 of the hair roller 10 by the flocking 24. Further, the flocking 24 prevents any hair from slipping off of the hair roller 10.

Figure 4:
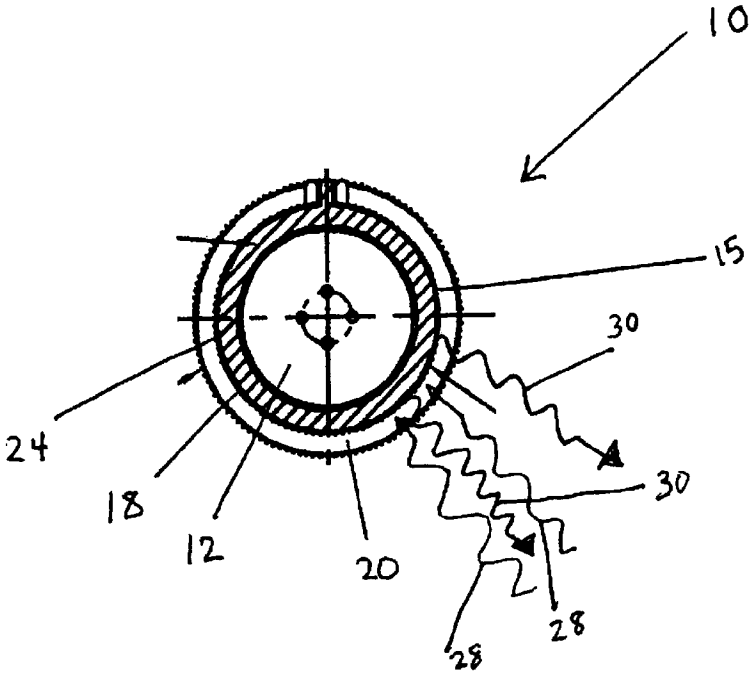
FIG. 4 is a cross-sectional view of the hair roller of FIG. 3 along line 4—4.

Referring to FIG. 4, the hair roller 10 preferably has the suitable ceramic 15 disposed on the flocking 24 of the hair roller, in the hair roller or coated to the hair roller. The ceramic 15 retains the heat for the extended period of time. The ceramic 15 evenly radiates the heat for an extended period of time at the preferred wavelength when the user's hair is wound around the outer surface 18 of the hair roller. The ceramic 15 provides for increased styling and curling of the hair wound around the hair. Preferably, the ceramic 15 on or in the flocking 24 is a number of ceramic particles, a ground ceramic, or a ceramic carrying paint. Less preferably, the ceramic 15 is any of a variety of hard, brittle and corrosion-resistant materials made by shaping and then firing. Such materials include a nonmetallic mineral, for example clay, at a high temperature that are then finely ground or pulverized.

The ceramic 15 preferably absorbs thermal energy that is emitted from hair styling devices such as a hair dryer or a heater as shown for illustration purposes only by arrow 28. In one instance, the hair roller 10 can be heated from the heater in the hair roller compartment as shown by arrow 28.

Thereafter, the ceramic 15 in or on the hair roller 10 radiates this heat. Preferably, the hair roller 10 radiates this heat to the hair curled on the hair roller for tighter curling action at the preferred wavelength as illustrated by arrow 30 in FIG. 4. One skilled in the art should appreciate that although being shown as arrows 28 and 30 for illustration purposes the heat will radiate in all directions from the ceramic 15 in or on the outer surface 18 of the hair roller 10.

Figure 5:
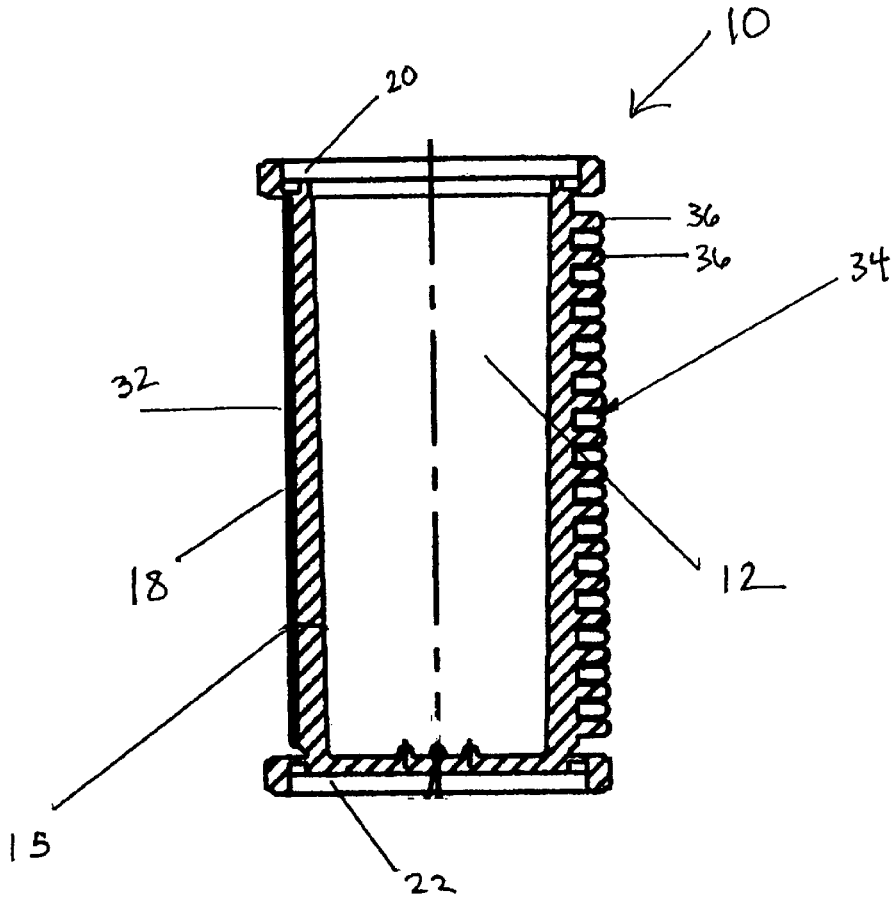
FIG. 5 is another cross-sectional view of the hair roller of FIG. 3 along line 5—5 with a starter strip connected to the hair roller having a number of teeth.

In one embodiment of the present invention, the ceramic 15 is in a powdered form. The ceramic 15 is then directly connected to the outer surface 18 of the hair roller 10. Referring to FIG. 5, the outer surface 18 has the adhesive layer 32 applied thereon. In this embodiment, the hair roller 10 may have a starter strip generally represented by reference numeral 34. The starter strip 34 is connected to the outer surface 18 of the body 12. The starter strip 34 preferably has a number of teeth 36. The teeth 36 assist with the curling action and preferably also comb the hair wound along the outer surface 18 of the hair roller 10. In one embodiment, the ceramic 15 forms a coating on the starter strip 34. In another embodiment, the ceramic 15 may be in a ground form. The ceramic 15 is then disposed in the flocking 24 and connected to the starter strip 34 or the teeth 36 by the adhesive layer 32.

Figure 6:
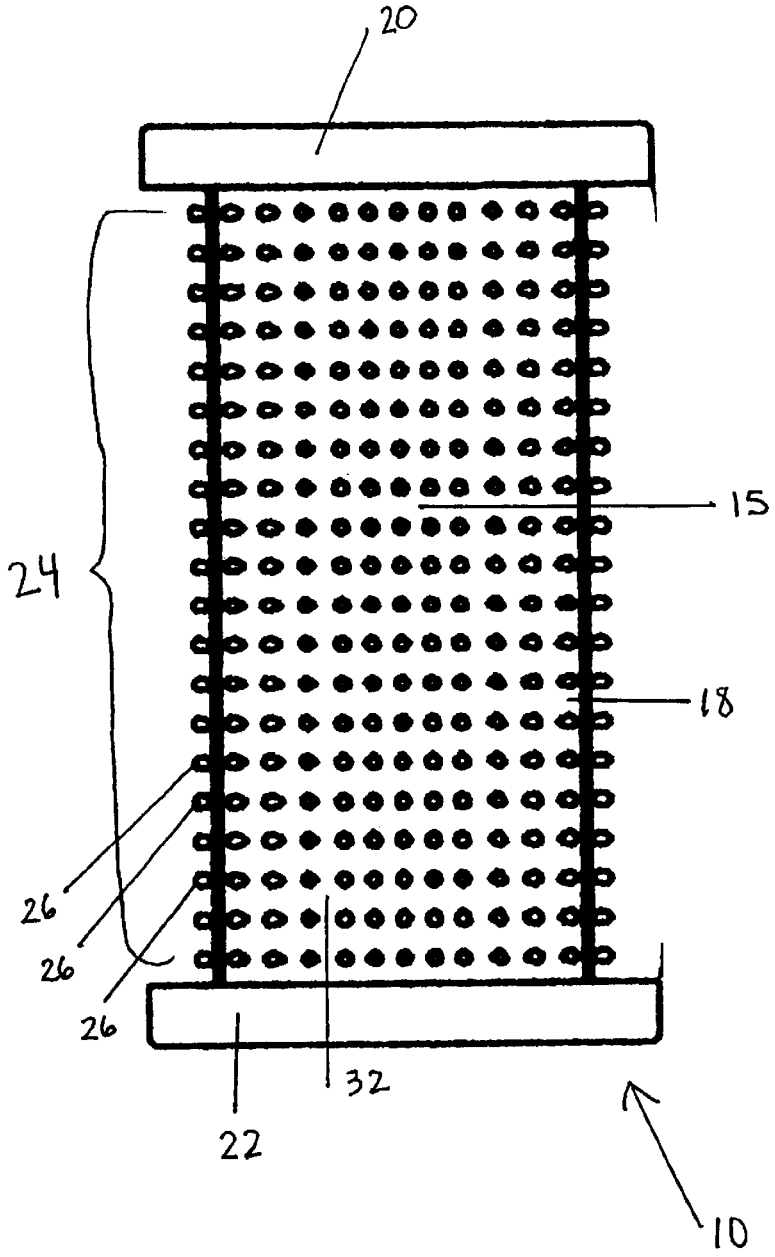
FIG. 6 is another side view of the hair roller having the flocking with the ceramic therein.

Referring to FIG. 6, alternatively the adhesive layer 32 may be mixed with the ceramic 15 in a first step. Thereafter, the ceramic 15 may be connected to the outer surface 18 when the adhesive layer 32 is applied to the hair roller 10. One skilled in the art should appreciate that the ceramic 15 should be mixed to achieve a uniform consistency prior to being applied to the hair roller 10. This ceramic 15 and adhesive layer 32 may further connect nylon fibers to the hair roller 10 in the pattern. One skilled in the art should appreciate that the ceramic 15 may be connected by other methods known in the art.

The ceramic 15 is preferably rough textured and increases a coefficient of friction of the flocking 24 on the outer surface 18. Preferably, this flocking 24 makes the outer surface 18 rougher relative to an instance of the prior art metallic hair roller. Accordingly, hair wound around the hair roller 10 will be gripped and remain wound around the outer surface 18. Once wound, the hair will not slip or traverse off of the outer surface 18 with the flocking 24 having the ceramic 15.

The ceramic 15 in the flocking 24 increases thermal conductivity of the flocking on the outer surface 18. The ceramic 15 relatively increases an amount of heat radiated off the outer surface at the preferred wavelength relative to the prior art metallic hair roller without the ceramic.

In another alternative preferred embodiment of the present invention, the body 12 of the hair roller 10 may be formed from a solid ceramic material. In this embodiment of the present invention, the body 12 is solid ceramic and may be optionally formed with the flocking 24 disposed on the outer surface 18.

Figure 7:
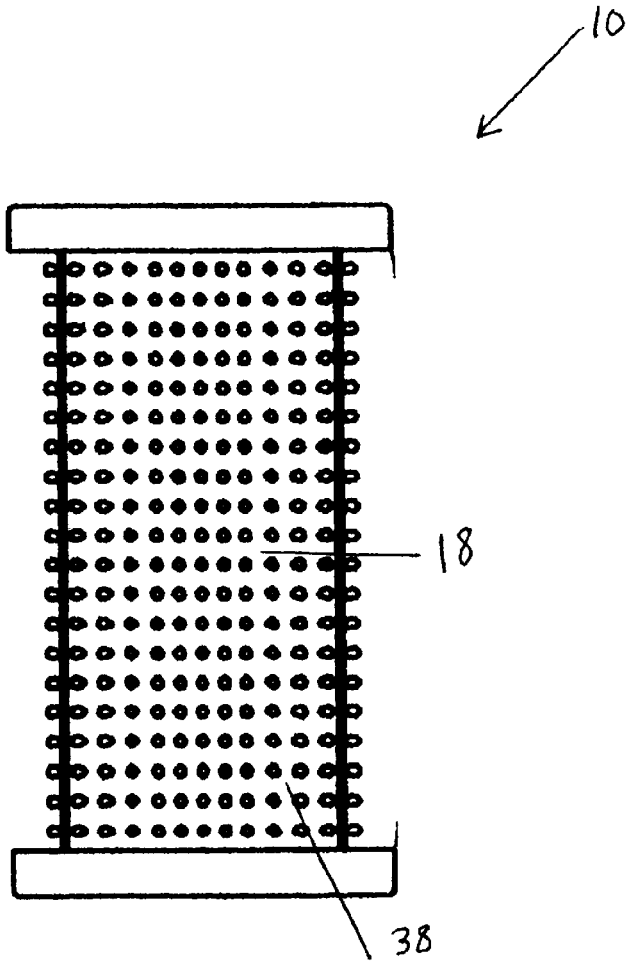
FIG. 7 is another side view of an alternative embodiment of the hair roller with a ceramic carrying paint.

In another alternative embodiment of the present invention, the hair roller 10 is made from a resilient base material, such as a metal, or a plastic. The hair roller 10 is then coated with a ceramic carrying paint 38 as shown in FIG. 7. In this embodiment of the present invention, the ceramic carrying paint 38 is selected for optimal heat absorption and conductivity. The ceramic carrying paint 38 may also be selected for other parameters such as cost and durability.

In this ceramic carrying paint 38 embodiment of the hair roller 10, a number of ceramic particles, a ceramic powder, a ground ceramic, a pulverized ceramic, a number of finely dispersed solid ceramic particles, or any combinations thereof are preferably combined with a suitable paint to form the ceramic carrying paint. These relatively smaller particles of ceramic material allow for a relatively higher concentration of ceramic material to be contained in the ceramic carrying paint 38 as compared to if larger ceramic particles are used. Preferably, a smaller particle size of the ceramic in the ceramic carrying paint 38 further minimizes granularity or a surface roughness of the outer surface 18 of the hair roller 10.

This minimal surface roughness is preferred and results in a smooth textured outer surface 18 of the body 12 of the hair roller 10. This minimal surface roughness assists in hair styling, hair curling and the texture of the hair while also gripping the hair wound on the outer surface 18. Preferably, an amount of the ceramic in the ceramic carrying paint 38 is suitable to absorb heat from, for example, the heater, or the hair dryer. The ceramic carrying paint 32 radiates this heat evenly for the extended period of time relative to the instance of the prior art metal hair rollers.

In this preferred embodiment of the present invention, the ceramic carrying paint 38 has powered or ground ceramic particles with a titanium dioxide. Preferably, an amount of ceramic material is added in a percentage of the total weight of the ceramic carrying paint 38. Preferably, the percentage range is about one percent to about fifty percent of the total weight of the ceramic carrying paint 38.

The ceramic carrying paint 38 is preferably made with conventional enamel paint. Alternatively, the ceramic carrying paint 38 may also have a rubberized texture to assist with the curling of the hair in a comfortable manner. Less preferably, the ceramic carrying paint 38 is made with an acrylic paint, a polyurethane paint, amino resin paint, or any other paint known in the art.

Figure 8:
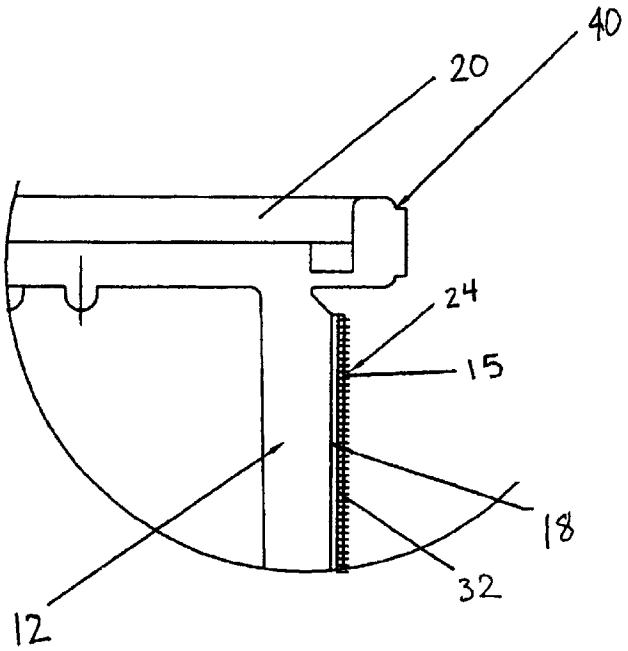
FIG. 8 is an enlarged view of a portion of the first end cap of the hair roller of FIG. 2.

Referring to FIG. 8, the hair roller 10 has the first end cap 20 that is preferably an outermost portion of the body 12 of the hair roller 10 and has an enlarged diameter relative to the diameter 14 of the body. The first end cap 20 preferably mates with a flange 40 that is integrally formed with the body 12. The flange 40 facilitates rapid assembly of the hair roller 10 during manufacture. Also, the user may grip the heated hair roller 10 at first end cap 20, and thus, prevent touching the heated ceramic 15 that is in the flocking 24.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A hair roller for curling hair comprising:

a body having a diameter, a height and an outer surface for winding the hair desired to be curled around said outer surface;

a flocking being connected to said outer surface;

an adhesive being around said outer surface of said body, said adhesive connecting said flocking to the hair roller;

a ceramic being in said flocking for transferring heat to assist in the curling of the hair, wherein said ceramic is in a ceramic based paint, said ceramic based paint being coated to said outer surface, and wherein said ceramic based paint has a titanium dioxide therein.

2. The hair roller of claim 1, wherein said ceramic is selected from the group consisting of a ceramic material, a plurality of ceramic particles, a ceramic powder, a ground ceramic, a pulverized ceramic, a plurality of finely dispersed solid ceramic particles, an adhesive having ceramic particles, and any combinations thereof.

3. The hair roller of claim 1, wherein said body has a first flanged end, and wherein said body has a second flanged end.

4. The hair roller of claim 1, wherein said body is made from a solid ceramic material.

5. The hair roller of claim 1, wherein said body has a first end and a second end each being made from a thermally nonconductive material.

6. The hair roller of claim 1, wherein said body is generally cylindrical in shape, and wherein said ceramic substantially covers said outer surface.

7. The hair roller of claim 1, wherein said flocking is a raised pattern on said outer surface, said flocking having said ceramic being a plurality of ceramic particles and, said flocking comprising a plurality of nylon fibers therein.

8. The hair roller of claim 1, wherein said ceramic retains and radiates thermal energy at a predetermined wavelength to assist in styling of the hair.

9. The hair roller of claim 1, wherein said ceramic based paint is brushed on only a portion of said outer surface.

10. The hair roller of claim 1, wherein said ceramic based paint is enamel paint.

11. The hair roller of claim 1, wherein said ceramic based paint has a rubberized texture.

12. The hair roller of claim 1, wherein said ceramic in said ceramic based paint is about one percent to about fifty percent of a total weight of said ceramic based paint.

13. The hair roller of claim 1, wherein said ceramic has a particle size such that said outer surface has a minimal surface roughness and grips hair wound on said outer surface.

14. The hair roller of claim 1, wherein the hair roller having the ceramic in said ceramic based paint is removably stored in a cassette, said cassette having a lid, said cassette having a heater therein for imparting heat to the hair roller.

15. The hair roller of claim 1, wherein said body is non-cylindrical.

16. The hair roller of claim 1, wherein said flocking is applied to only a portion of said outer surface.

17. The hair roller of claim 1, wherein said flocking is connected to said hair roller by a fastener.

18. The hair roller of claim 1, wherein said ceramic is spaced from said flocking by a spacing arrangement, said spacing arrangement being selected from the group consisting of proximal to said flocking, adjacent said flocking, on a top of said flocking, on a bottom of said flocking, near said flocking, suspended in said flocking, not in said flocking, and any combinations thereof.

19. A hair roller for curling hair comprising:

a body having a diameter, a height and an outer surface for winding the hair desired to be curled around said outer surface;

a flocking being connected to said outer surface;

an adhesive being around said outer surface of said body, said adhesive connecting said flocking to the hair roller;

a ceramic being in said flocking for transferring heat to assist in the curling of the hair, wherein said ceramic is in a ceramic based paint on said outer surface, said ceramic based paint having a plurality of ceramic particles disposed therein, said ceramic based paint having titanium dioxide disposed therein.

20. A hair roller for curling hair comprising:

a cylindrical roller body having a diameter, a height, an outer winding surface, a first end, and a second end, said first end and said second end each having an end cap made from a thermally nonconductive material, said outer winding surface for winding the hair desired to be curled around said outer winding surface;

a comb having one or more teeth, said comb being connected to said outer winding surface;

a flocking being substantially around said outer winding surface, said flocking having a plurality of protrusions, said plurality of protrusions providing a texture to the hair being curled around said flocking; and a paint being coated to said outer winding surface, said paint having a ground ceramic powder and a titanium dioxide therein, said ground ceramic powder for retaining heat to assist in the curling of the hair disposed around said outer winding surface, wherein said paint has a texture selected from the group consisting of a hard enamel texture, a rubberized texture, and any combination thereof.

* * * * *